US007882572B2

(12) United States Patent
Wong

(10) Patent No.: US 7,882,572 B2
(45) Date of Patent: Feb. 8, 2011

(54) ELASTIC CAP

(75) Inventor: Cham Wah Wong, Hong Kong (CN)

(73) Assignee: Global One Headwear Limited, Hong Kong (HK)

( * ) Notice: Subject to any disclaimer, the term of this patent is extended or adjusted under 35 U.S.C. 154(b) by 159 days.

(21) Appl. No.: 11/907,560

(22) Filed: Oct. 15, 2007

(65) Prior Publication Data

US 2008/0034473 A1 Feb. 14, 2008

Related U.S. Application Data

(63) Continuation-in-part of application No. 11/010,686, filed on Dec. 13, 2004, now abandoned.

(30) Foreign Application Priority Data

Dec. 23, 2003 (HK) ..... 03109342.3

(51) Int. Cl.
*A42C 5/02* (2006.01)

(52) U.S. Cl. ..... 2/181; 2/181.6; 2/182.3; 2/209.4

(58) Field of Classification Search ..... 2/181, 2/181.6, 182.3, 209.4
See application file for complete search history.

(56) References Cited

U.S. PATENT DOCUMENTS 4,856,116 A * 8/1989 Sullivan ..... 2/181
5,715,540 A * 2/1998 Cho ..... 2/195.3
6,016,572 A * 1/2000 Park ..... 2/195.2
6,052,831 A 4/2000 Park
6,122,774 A * 9/2000 Park ..... 2/181
6,131,202 A * 10/2000 Yan ..... 2/195.3
6,868,559 B1 * 3/2005 Wong ..... 2/195.3
2005/0160518 A1 * 7/2005 Cho ..... 2/181

FOREIGN PATENT DOCUMENTS

EP 0639338 2/1995

OTHER PUBLICATIONS

European Search Report of EP04258011, Aug. 3, 2006.
Office Action of EP0425811, Jun. 26, 2008.
International Search Report of PCT/CN2008/072677, Jan. 22, 2009.

* cited by examiner

*Primary Examiner*—Gary L Welch
*Assistant Examiner*—Alissa J Tompkins

(57) ABSTRACT

The elastic cap includes a cap body, a cap bill joined to the cap body, a sweatband secured to a lower periphery of the cap body, and a strip of core wrapped by the sweatband. The sweatband is constructed with a stretchable material. The strip of core is constructed with a non-stretchable material having a liquid absorbent or liquid draining property. The strip of core extends over a forward portion of the sweatband adjacent to the cap bill, but does not extend in a rear portion of the sweatband which is remote from the cap bill.

15 Claims, 6 Drawing Sheets

ELASTIC CAP

CROSS REFERENCE TO RELATED APPLICATION

This application is a continuation-in-part (CIP) of U.S. patent application Ser. No. 11/010,686 filed Dec. 13, 2004 now abandoned, which claimed priority of Hong Kong patent application no. 03109342.3 filed Dec. 23, 2003.

FIELD OF APPLICATION

The present application generally relates to head coverings, in particular, the application relates to an elastic cap constructed of a fabric and having structures which allow the cap to be used on a variety of sized heads.

BACKGROUND

Caps and hats are a staple of contemporary fashion apparel as well as providing functional protection against the environment. Typically, hats and caps are offered in either a single size or a variably adjustable size configuration. Size adjustment is an important quality for manufacturers of hats and caps since when the hat or cap is adjustable, the manufacturer needs to produce only hats and caps of a single or limited configuration.

Consumers of hats and caps require adjustability since head size is highly variable throughout the population. In addition, a change in a wearer's hair length or style may alter the fitting of a cap. Conventional adjustable caps utilize such things as plastic adjusting bands having a plurality of holes and associated pegs. A cap user can alter the fitting of the cap by changing the position of the pegs in the holes. This allows the cap user to either increase or decrease the size of the cap. Other caps use an adjustable sliding strap, while still other caps use an elastic cord to allow for size adjustment. However, these types of conventional caps have some disadvantages. For example, caps using the plastic adjusting strap often interfere with the wearer's hair or clothing. This may occur when the wearer turns, raises or lowers his or her head. During these movements, the plastic strap often becomes entangled in the hair or clothing, thus causing extreme discomfort to the wearer.

In other cases where the cap uses an elastic sweatband to adjust size, the elastic produces a folded or wavy deformation around the periphery of the cap. In addition to not being aesthetically pleasing, the folds or wave can result in an insecure and uncomfortable wearing experience for the wearer.

SUMMARY

The present application is directed to an elastic cap. The elastic cap includes a cap body, a cap bill joined to the cap body, a sweatband secured to a lower periphery of the cap body, and a strip of core wrapped by the sweatband. In one embodiment, the cap body includes a plurality of joined sector blades. The sweatband is constructed with a stretchable material, and the strip of core is constructed with a non-stretchable material. The strip of core extends over at least four sector blades in a forward portion of the sweatband, but does not extend in a rear portion of the sweatband which is remote from the cap bill.

In another embodiment, the sweatband is constructed with a stretchable material. The strip of core is constructed with a non-stretchable material having a liquid absorbent or liquid draining property. The strip of core extends over a forward portion of the sweatband adjacent to the cap bill, but does not extend in a rear portion of the sweatband which is remote from the cap bill.

In yet another embodiment, the sweatband is constructed with a stretchable woven fabric or a stretchable knitted fabric. The strip of core is constructed with a non-stretchable non-woven material, a non-stretchable woven material, or a non-stretchable knitted material having a liquid absorbent or liquid draining property. The strip of core extends in a forward portion of the sweatband adjacent to the cap bill, but does not extend in a rear portion of the sweatband which is remote from the cap bill.

DETAILED DESCRIPTION

Figure 1:
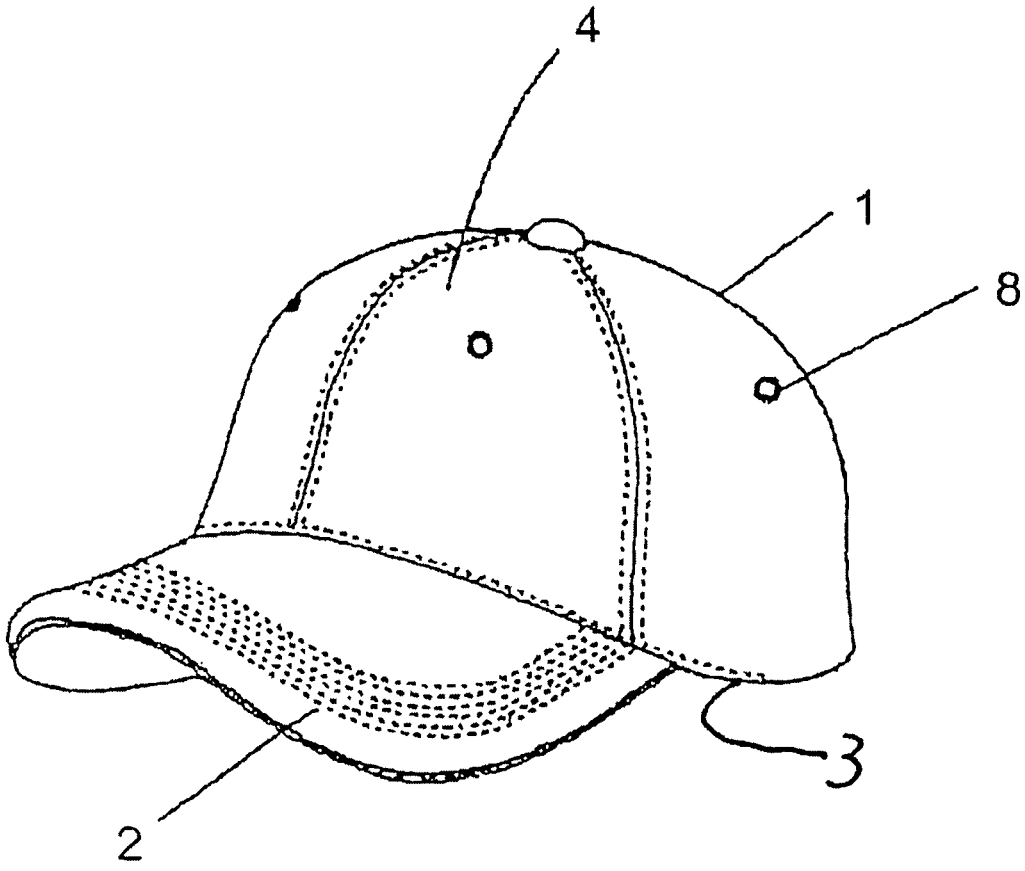
FIG. 1 is a perspective view of an elastic cap.
Figure 2:
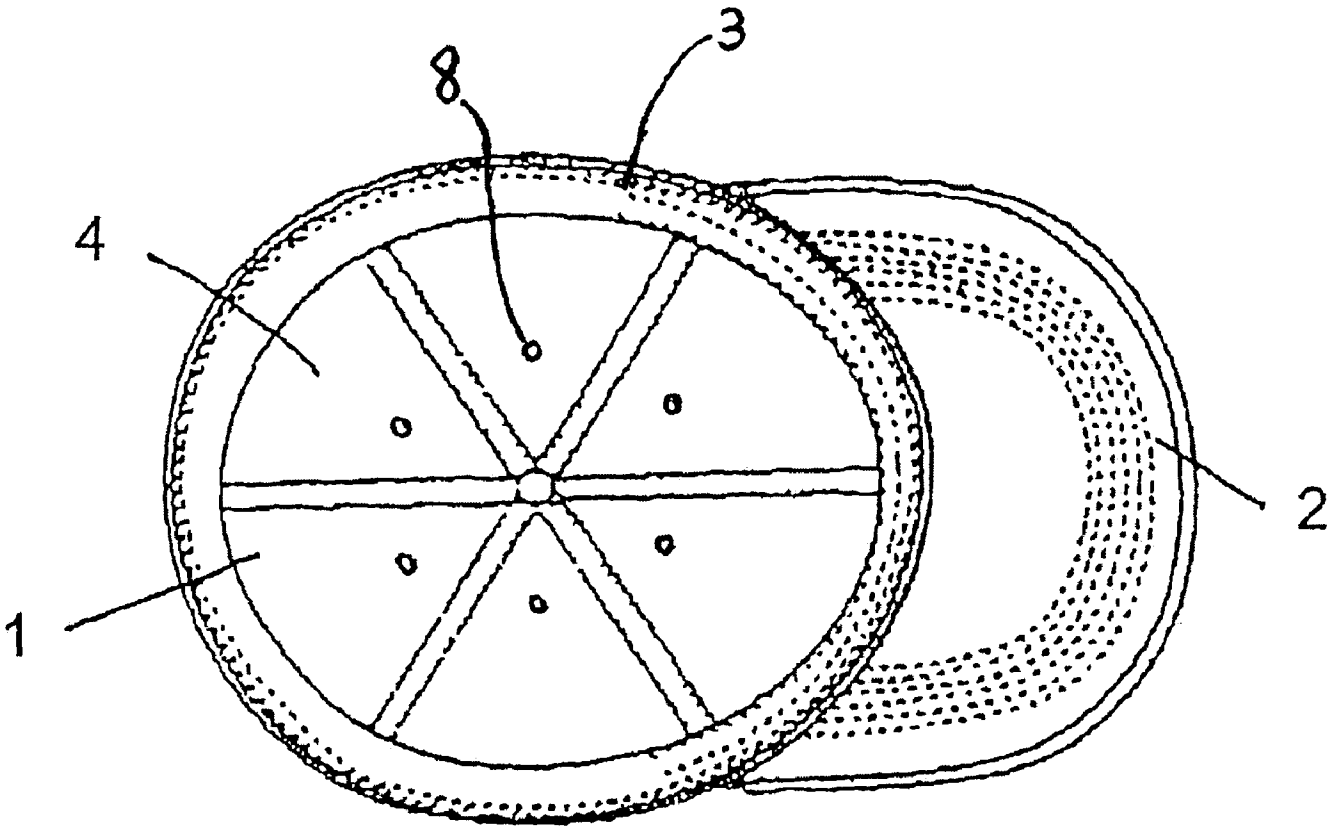
FIG. 2 is a bottom view of the elastic cap of FIG. 1.

With reference to FIGS. 1 and 2, in one embodiment, an elastic cap includes a cap body 1, a cap bill 2 joined to the cap body 1, and a sweatband 3 secured to a lower periphery of the cap body 1. The material used to construct the cap may be a fabric woven or knitted material from a highly elastic yarn as the woof (the yarn woven across the warp yarn) and a substantially un-stretchable yarn as the warp. For example, the highly elastic yarn may be composed of 11646/20*16+70D fibers which include 97% cotton and 3% spandex material. The un-stretchable yarn may be composed of 9042/12*10+70D fibers which include 97% cotton and 3% spandex material.

The cap body 1 may include multiple sector blades 4. For example the cap body 1 may include six sector blades 4. The cap bill 2 is, for example, of a perspective arc shape. This shape can be achieved by forming the cap bill 2 to a model of a typical wearer's forehead. The bill 2 may include an internal plate (not shown) which adds structural rigidity to the bill 2. The plate may be composed of plastic or natural materials. For example, the plate may be constructed with polyethylene, cardboard and/or other material well known in the cap art.

In one embodiment, the cap top has a plurality of holes 8 which allow for air permeability and heat dissipation. For example, there may be one hole in each of the sector blades 4. For example, if there are six sector blades 4 then there would be six holes 8. The air permeability and heat dissipation, provided by the holes 8, allows fresh air to reach a wearer's head and allows head generated by the wearer to escape.

Figure 3:
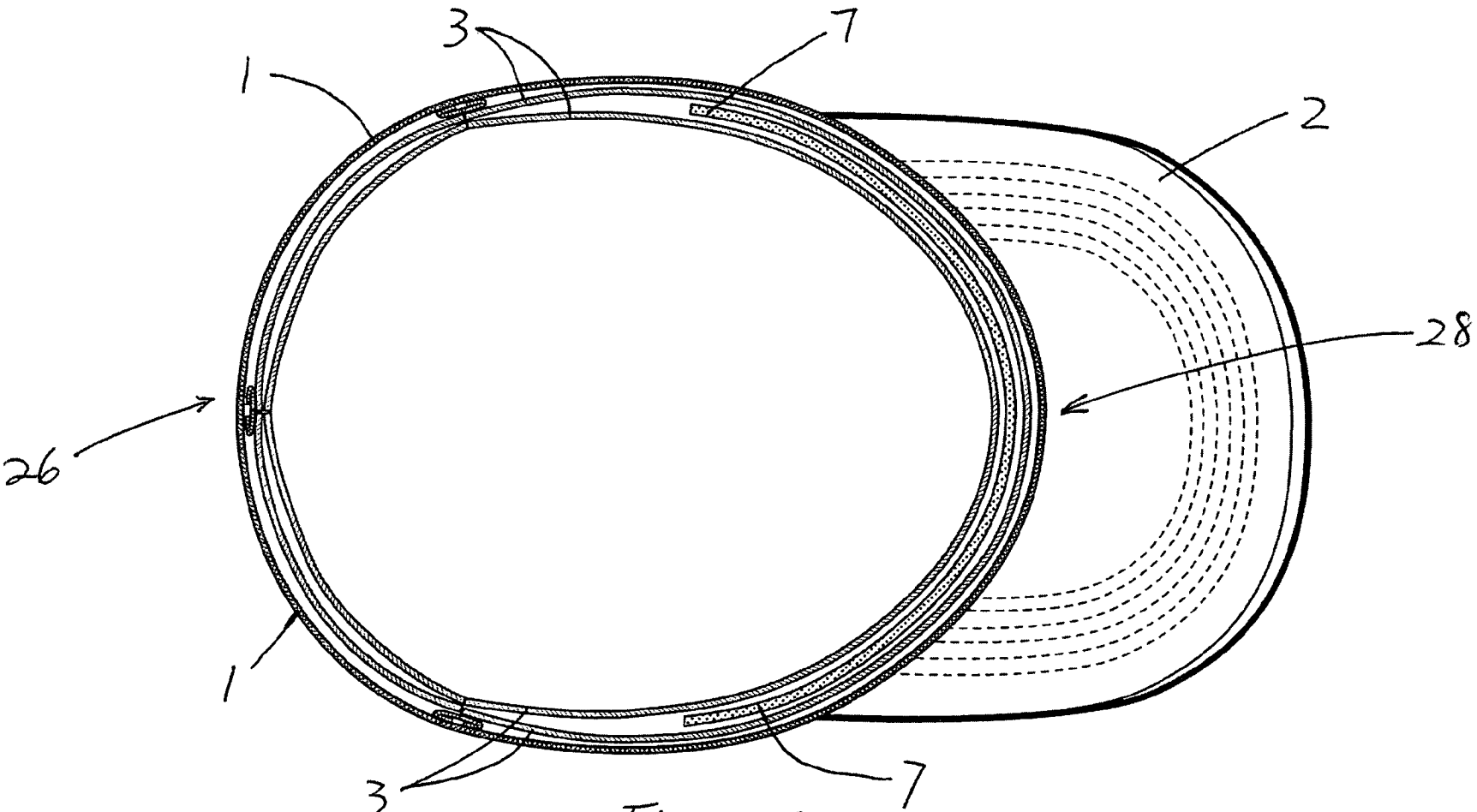
FIG. 3 is a cut away view of a sweatband and a core of the elastic cap of FIG. 1.

Referring to FIG. 3, the sweatband 3, in one embodiment, is secured to the lower periphery of the cap body 1 by highly elastic thread (not shown). The highly elastic thread provides the periphery of the cap with an unexpected stretching potential. The attachment with the highly elastic thread also allows the periphery of the cap to elastically expand or contract. For example, the periphery of the cap may elastically expand or contract five to six centimeters. The highly elastic thread, when used for attachment of the sweatband 3 to the cap body 1, provides elasticity in both the vertical and horizontal directions. In addition to maintaining the elasticity of the sweatband 3 for securing the hat to a wearer's head, the highly elastic thread contributes to the prevention or reduction of the head clamping phenomena often experienced with conventional caps. The elastic thread included the property of being able to elastically stretch at least twice its unstretched length.

In another embodiment, the sweatband 3 is a lower portion of the cap body 1.

The sweatband 3 can be constructed with a stretchable material adapted to wrap around the wearer's head. The stretchable material may be a soft cloth fabric such as a woven fabric or a knitted fabric. As the sweatband 3 is stretchable, it can fit the heads of different wearers having different sizes.

Figure 4:
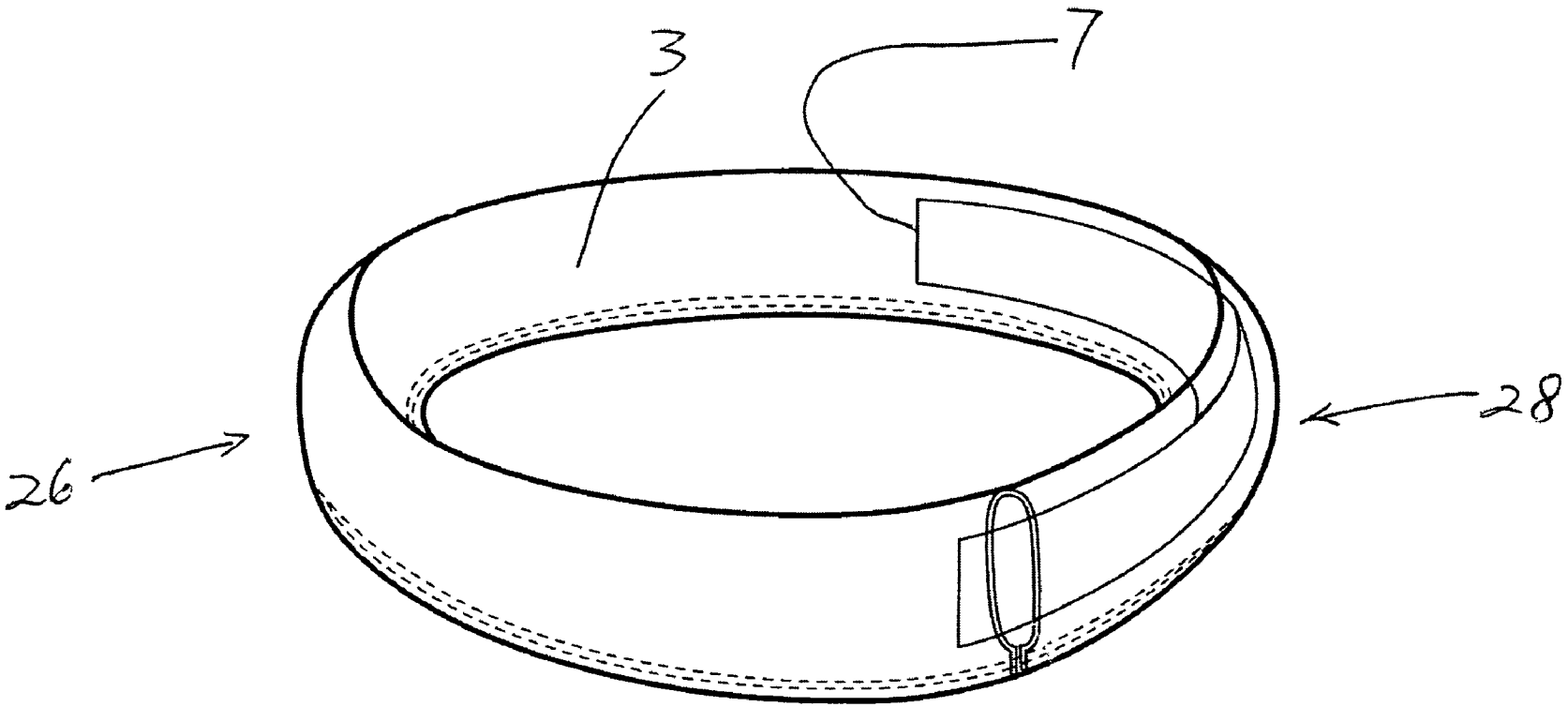
FIG. 4 is a transparent view of the sweatband and the core.
Figure 5:
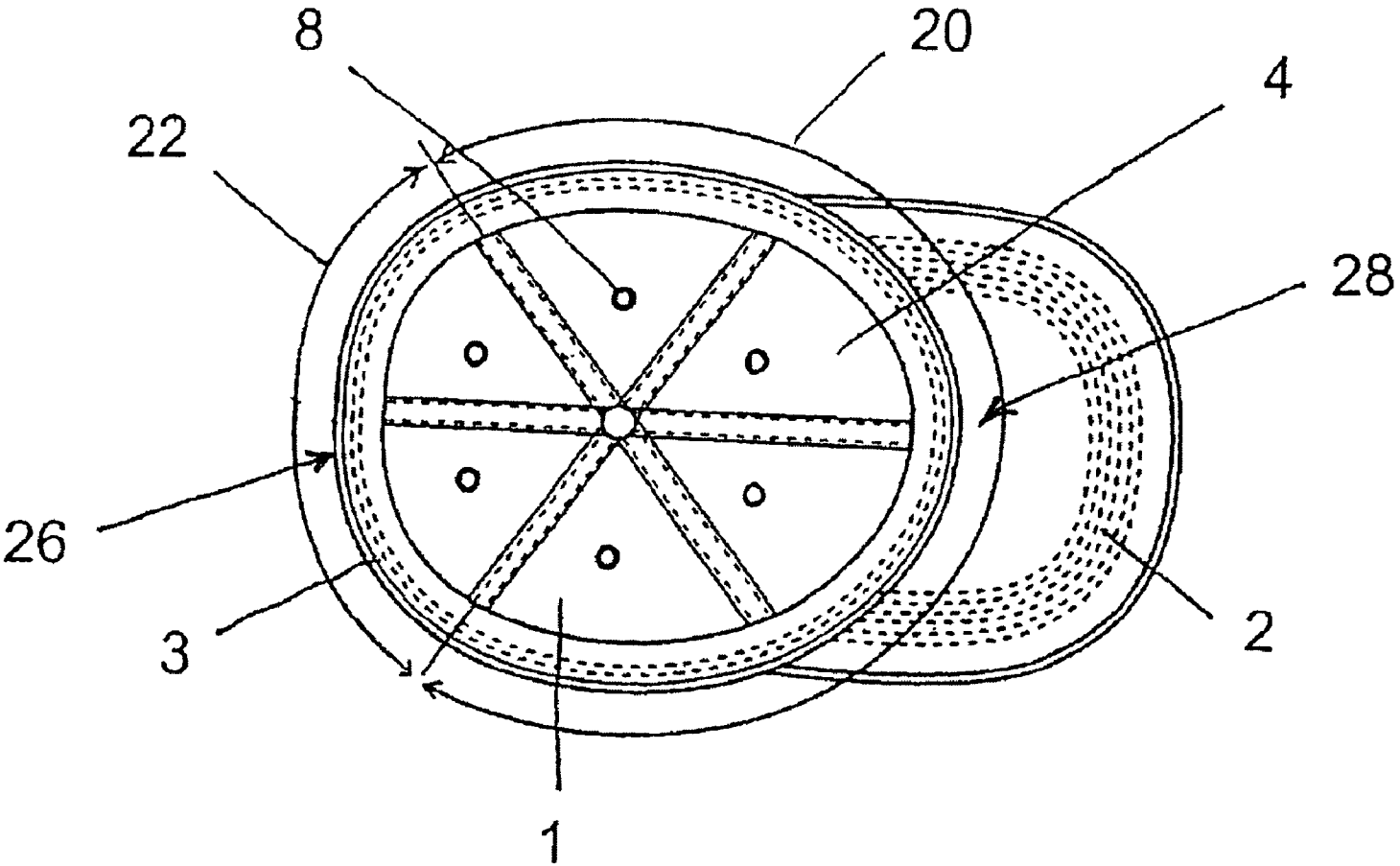
FIG. 5 is a bottom view of the elastic cap showing an example of the extent to which the core extends about the perimeter of the elastic cap.
Figure 6B:
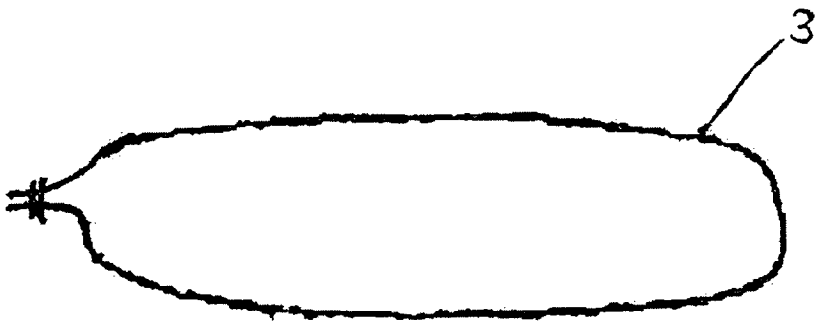
FIG. 6B is a sectional view of rear portion of a sweatband included in an elastic cap.
Figure 6A:
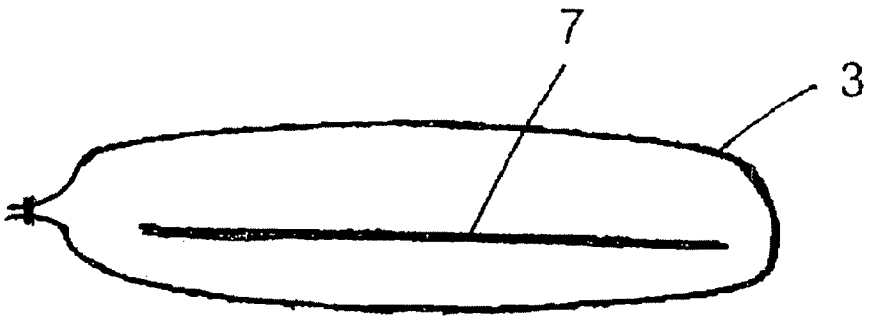
FIG. 6A is a sectional view of forward portion of a sweatband included in an elastic cap.

Referring to FIGS. 3, 4 and 6A, a strip of core 7 is wrapped by the sweatband 3. The core 7, in one embodiment, as shown in FIGS. 3, 4, 6A and 6B extends partially about the perimeter of the sweatband 3. In particular, the core extends over a forward portion of the sweatband which is adjacent to the cap bill 2, but does not extend in a rear portion of the sweatband which is remote from the cap bill 2. The core 7 can be loosely sandwiched inside the sweatband 3. FIG. 5 shows a first extent line 20 that illustrates the length and position of the core 7 within the forward portion 28 of the sweatband 3. A second extent line 22 illustrates the length and position of the rear portion 26 of the sweatband 3 which does not contain the core 7.

The core 7 is configured to influence the shape of the whole cap. The core 7 is constructed with a strip of non-stretchable material, such as a non-woven material, a woven material, or a knitted material. The core 7 is bendable and stiffer than the material of the sweatband 3.

The bending rigidity of the non-stretchable material for the core 7 is higher than conventional lining materials, such as a foam material. Test data shows that the bending rigidity of a non-stretchable woven material is about 58.89 gf.cm, while the bending rigidity of a foam material is about 18.96 gf.cm. Therefore, the non-stretchable material for the core 7 has a better shape retention capability than the foam material.

In addition, the traditional foam material is springier and more compressible than the non-stretchable material (such as a non-woven material, a woven material, or a knitted material) for the core 7. If the core 7 is constructed with the traditional foam material, the foam material would tightly fit along the contour of the sweatband 3 and generate a relatively high pressure on the wearer's forehead when the wearer holds the cap bill 2 and turns the cap. In contrast, if the core 7 is constructed with the non-stretchable material, porous spaces would exist at the concave portions of the sweatband 3. A relatively low pressure would generate on the wearer's forehead when the wearer holds the cap bill 2 and turns the cap. Test data shows that work done per unit area to compress a foam material until full loading of 50 $gf/cm^2$ is about 0.866 $gf.cm/cm^2$, while work done per unit area to compress a non-stretchable woven material until full loading of 50 $gf/cm^2$ is about 0.224 $gf.cm/cm^2$.

Furthermore, unlike conventional lining materials (such as plastic), the non-stretchable material (such as a non-woven material, a woven material, or a knitted material) for the core 7 has a liquid absorbent or liquid draining property which allows for the management of sweat produced by a wearer of the cap. The core 7 can, prior to cap construction, be immersed in a chemical for treatment. For example, the core 7 may be immersed in the chemical for about four hours to modify moisture management properties. Such a chemical may modify the hydrophilic and hydrophobic properties of portions of the core.

Referring to FIGS. 3 and 5, the cap has six sector blades 4, and the core 7 is included in the sweatband 3 at the forward portion 28 of the cap and has a length that spans about four or more sector blades 4 in the illustrated embodiment. The sweatband 3 at the rear portion 26 of the cap does not include the core for a length of about two sector blades 4. The forward portion of the sweatband 3 with the core 7 provides some cap wearing characteristics. For example, the stiffness of the core 7 provides for a cap which stands generally erect at its forward portion and thereby enhances the appearance of the cap. The rear portion of the sweatband 3 without the core 7 also provides some cap wearing characteristics. For example, the cap does not produce a head clamping effect on the wearer. The head clamping effect includes excessive pressure on the wearer's head and/or points of pressure on the wearer's head.

The cap may be constructed, as shown in FIGS. 3, 4 and 6*a*, in one embodiment, by putting the core 7 between a double folded sweatband 3. The double folded sweatband 3 may be material of the original cap body 1 or may be different from the cap body 1. For example, the sweatband 3 may include a double folded material which is knitted fabric and the cap body 1 may include woven fabric or vice versa. The double folded material 23 is then sealed by a sewn seam 24. The sweatband 3, when sewn, includes a level and smooth appearance.

In one embodiment, the rear bottom of the cap 26 is configured to form an inner arc shape. The shape is achieved by, among other things, the stretchable fabric. This shape allows the hat, when placed on the wearer's head, to remain substantially flat. Among other thing, this shape provides an improved secure attachment to a wearer's head.

While preferred embodiments of the foregoing application have been set forth for the purpose of illustration, the foregoing description should not be deemed a limitation of the application herein. Accordingly, various modifications, adaptations and alternatives may occur to one of skill in the art without departing from the spirit and scope of the present application.

I claim:

1. An elastic cap comprising:

a cap body comprising a plurality of joined sector blades;

a cap bill joined to the cap body;

a sweatband, which is constructed with a stretchable material, secured to a lower periphery of the cap body; and a strip of core, which is constructed with a non-stretchable material, wrapped by the sweatband, the strip of core extending over at least four sector blades in a forward portion of the sweatband, but not extending in a rear portion of the sweatband which is remote from the cap bill; wherein there is a hollow space between the strip of core and the sweatband.

2. The elastic cap of claim 1, wherein the sweatband is constructed with a woven fabric or a knitted fabric.

3. The elastic cap of claim 1, wherein the strip of core is constructed with a non-woven material, a woven material, or a knitted material.

4. The elastic cap of claim 1, wherein the strip of core comprises a liquid absorbent or liquid draining property.

5. The elastic cap of claim 1, wherein the strip of core is chemically treated.

6. The elastic cap of claim 1, wherein the strip of core is stiffer than the sweatband.

7. The elastic cap of claim 1, wherein the sweatband is secured to the lower periphery of the cap body by a highly elastic thread.

8. An elastic cap comprising:

a cap body;

a cap bill joined to the cap body;

a sweatband, which is constructed with a stretchable material, secured to a lower periphery of the cap body; and a strip of core constructed with a non-stretchable material having a liquid absorbent or liquid draining property, the strip of core wrapped by the sweatband, the strip of core extending over a forward portion of the sweatband adjacent to the cap bill, but not extending in a rear portion of the sweatband which is remote from the cap bill; wherein there is a hollow space between the strip of core and the sweatband.

9. The elastic cap of claim 8, wherein the sweatband is constructed with a woven fabric or a knitted fabric.

10. The elastic cap of claim 8, wherein the strip of core is constructed with a non-woven material, a woven material, or a knitted material.

11. The elastic cap of claim 8, wherein the strip of core is stiffer than the sweatband.

12. The elastic cap of claim 8, wherein the strip of core is chemically treated.

13. The elastic cap of claim 8, wherein the sweatband is secured to the lower periphery of the cap body by a highly elastic thread.

14. An elastic cap comprising:

a cap body;

a cap bill joined to the cap body;

a sweatband, which is constructed with a stretchable woven fabric or a stretchable knitted fabric, secured to a lower periphery of the cap body; and a strip of core constructed with a non-stretchable non-woven material, a non-stretchable woven material, or a non-stretchable knitted material having a liquid absorbent or liquid draining property, the strip of core wrapped by the sweatband, the strip of core extending in a forward portion of the sweatband adjacent to the cap bill, but not extending in a rear portion of the sweatband which is remote from the cap bill; wherein there is a hollow space between the strip of core and the sweatband.

15. The elastic cap of claim 14, wherein the strip of core is stiffer than the sweatband.

* * * * *